United States Patent [19]

Edelson et al.

[11] Patent Number: 5,065,144

[45] Date of Patent: Nov. 12, 1991

[54] APPARATUS FOR MIX-RUN ENCODING OF IMAGE DATA

[75] Inventors: Steven D. Edelson, Wayland, Mass.; Gary J. Frattarola, Merrimack; George L. Heron, Derry, both of N.H.

[73] Assignee: Analog Devices, Inc., Norwood, Mass.

[21] Appl. No.: 510,255

[22] Filed: Apr. 17, 1990

[51] Int. Cl.[5] ..... G09G 1/28

[52] U.S. Cl. ..... 340/703; 340/728

[58] Field of Search ..... 340/703, 728; 358/75, 358/80

[56] References Cited

U.S. PATENT DOCUMENTS 4,233,601 11/1980 Hankins et al. ..... 340/703
4,482,893 11/1984 Edelson .
4,591,897 5/1986 Edelson .
4,704,605 11/1987 Edelson .
4,733,230 3/1988 Karihara et al. ..... 340/703
4,763,283 8/1988 Coutrot ..... 340/703

*Primary Examiner*—Alvin E. Oberley
*Assistant Examiner*—Regina Liang
*Attorney, Agent, or Firm*—Cesari & McKenna

[57] ABSTRACT

An encoder (12) in an image-display system converts explicitly represented pixel values from an image source (14) into mix-run-encoded representations thereof and stores them into the locations of a display memory (16). A display mechanism (18) draws the resultant stored data from the display memory and interprets them in accordance with a mix-run-encoding scheme of a type previously used for anti-aliasing purposes. As a consequence, the system is able to provide a wide range of color shades with only modest-sized display and palette memories (16 and 36).

13 Claims, 7 Drawing Sheets

APPARATUS FOR MIX-RUN ENCODING OF IMAGE DATA

BACKGROUND OF THE INVENTION

The present invention is directed to image-display systems and in particular to the manner in which such systems store image data.

The typical electronic display system employs a cathode-ray tube or other device to display images presented to it as sequences of voltages. Digital-to-analog converters produce the sequences of analog voltages in response to image data read from a fast display memory at a rate the same as that at which the device displays the data on its screen.

The image is organized into picture elements, or pixels. A typical full-screen image may be organized in an array of, say, 640 pixels per line by 480 lines. For a color monitor, the value of each pixel is represented as a three-dimensional (red, green, blue) vector, and each component of that vector may require, say, eight bits of resolution. Consequently, to specify the complete range of colors possible throughout an image of that size requires a display memory whose size is on the order of 8 bits/component×3 components/vector×640 vectors/-line×480 lines, i.e., more than seven megabits of storage. Since the display memory must be fast enough to keep up with the scan rate of the display device, such a storage requirement contributes significantly to the cost of a display system, and such cost is not acceptable for lower-end systems.

Fortunately, techniques have been found to reduce the display-memory size. The typical technique employs a "palette memory." A palette memory enables the display memory, which would otherwise have to contain, say, 8 bits/component×3 components/pixel=24 bits/pixel, to employ only, say, four or eight bits per pixel for the same resolution. The palette memory is interposed between the display memory and the digital-to-analog converters, and it interprets the, say, eight-bit output of the display memory as the address of one of its $2^8=256$ twenty-four-bit locations. That is, instead of containing all $2^{24}$ possible vectors, it contains a "palette" of only 256 user-selected values in an eight-bit system. The user can still use any of the $2^{24}$ possible values, but he can employ only 256 of them in any single image. Such a range of values is more than adequate for the display of most computer-generated graphics applications, so a user needs to resort to higher-end systems only to display natural images and computer-generated images that result from programs that employ shading.

SUMMARY OF THE INVENTION

The present invention is a mechanism for greatly expanding the range of shades that a low-end system can employ in a single image so that it, too, can display natural and other shaded images. Specifically, the present invention is a method and apparatus for applying the concept of "mix-run encoding" to natural and other shaded images.

The technique of mix-run encoding is described in U.S. Pat. No. 4,704,605, which issued on Nov. 3, 1987, to Steven D. Edelson for a Method and Apparatus for Providing Anti-Aliased Edges in Pixel-Mapped Computer Graphics. That patent describes a technique for eliminating the jagged edges that often appear between regions of different colors in computer-generated images. The jagged edges result because the spatial resolution of the cathode-ray tube or other display device does not satisfy the Nyquist criterion for the spatial-frequency range of the underlying data. The technique of the '605 patent largely eliminates the jagged edges without employing computation-intensive conventional filtering of the underlying data to eliminate its higher-spatial-frequency components.

In accordance with that technique, each scan line is considered to have finite thickness, and each pixel is considered to have finite width. Therefore, an edge that passes through a scan line at an angle with the horizontal divides one or more pixels in two. The display memory represents each pixel through which the edge passes as a mix of the colors on the two sides of the edge, the proportion of the mixture depending on what fraction of the pixel is on each side of the edge.

The present invention is an adaptation of the method that the '605 patent discloses for implementing this concept. In mix-run encoding, the pixel word for the pixel through which an edge passes is not a self-contained indication of the shade that the pixel is to display; i.e., it is not the palette-memory address of the pixel value that results from the mix. Instead, it contains a fraction from which the pixel value to be displaced must be computed by appropriately applying that fraction to the two pixel values to be mixed, and at least one of those values must be ascertained by reference to the contents of the pixel word for a different pixel.

In the system of the '605 patent, computation apparatus receives the outputs of the display and palette memories, latches in the palette-memory values for the two sides of the edge, computes a mixture of the two colors in accordance with the fractions represented by the pixel words for the edge pixels, and applies the resultant value, all in real time, to the digital-to-analog converters that control the CRT display. The effect is largely to eliminate aliasing without performing conventional two-dimensional filtering.

The present invention extends the mix-run concept to the display of image features that are not necessarily edges and have not necessarily originated in computer-graphics systems. In doing so, it takes advantage of the fact that the use of the computation circuitry makes it possible to display shades that are not in the palette memory, i.e., to display shades interpolated between palette-memory values. The images on which it employs mix-run encoding, and thereby obtains its palette-expanding capabilities, typically come from sources that represent the images in the conventional pixel-by-pixel manner. (By pixel-by-pixel manner, we mean that each of the individual pixel words, which correspond to respective image pixels contains some type of representation that does not require reference to the values of any of the other pixels in order to determine the pixel value to be displayed.)

According to the present invention, a mix-run encoder converts the strictly pixel-by-pixel representation into a "mix-run" representation and stores the result in the display memory. (The '605 patent gives examples of codes for such representations.) To perform the conversion, the encoder searches through the source pixel words to find sequences that lend themselves to translation into a "run" of pixel words in the mix-run representation. In such a representation, a run is characterized by a set of, typically, two values from which the various mixes in the run are to be computed. The mix-run representation typically presents the characteristic values in essentially a pixel-by-pixel manner as the two pixel words at the start of the run, and it may choose as the characteristic values those at the beginning and end of the source sequence that it translates into the run. The remaining, intervening pixel words in the run represent their pixel values as fractions, which must be applied to the (typically two) characteristic values for that run in order to arrive at the intended pixel values.

The encoder begins by inspecting a short sequence from the source pixel words that make up an image. If the pixel values that the sequence represents can be adequately approximated as mixes of a common set of characteristic values, the encoder recognizes that sequence as one acceptable for translation, adds a further source pixel word to it, and determines whether the lengthened sequence is also acceptable. If so, the process continues. If not, it can adopt the last acceptable sequence for translation into a run and repeat the process with subsequent sequences.

The resultant mix-run-encoded rendition of the original image usually appears subjectively very close to the original image, and this result is achievable at an additional hardware cost that is minuscule in comparison with that of increasing display-memory size by the three or more times that typically would otherwise be required.

For some images, though, we have found that application of this technique can sometimes result in noticeable streaks in the image even when the mixing approximations differ from the source image by as little as one bit. To accept only sequences that can be exactly achievable by mixes, however, may make the palette-size requirement excessive. According to one aspect of the invention, we largely eliminate the occurrence of such streaks by accepting approximations but making the stringency of the sequence-acceptance criteria depend on sequence length. In the embodiment described below, for instance, we reduce the maximum acceptable error as sequence size increases. We have found that this technique greatly increases the subjective acceptability of the resultant image without increasing the number of runs excessively. The reason for this is apparently that larger errors are less noticeable in short runs than in long runs.

As was mentioned above, one can employ a code in which sequence endpoints are chosen as the characteristic values, and the process of choosing source sequences to be encoded into display-memory run would involve repeatedly lengthening a candidate sequence of source pixel words by one word and determining whether the intermediate values in the sequence are interpolable from its endpoints. If the intervening pixel words of the lengthened sequence are not interpolable between the first and last pixel words in the sequence, one could drop back to the last acceptable length and adopt the resulting sequence for translation into a run. While this approach readily results in images properly encoded in accordance with a mix-run code, we have found that the "textured" areas of certain images cause this approach to result in a lot of short runs. This is undesirable because it tends to make the required palette large. In accordance with certain aspects of the invention, we reduce this problem considerably.

For example, in accordance with one aspect of this invention, which we call "ignoring local maxima," we sometimes extend the length of a candidate sequence of source pixel words even though the candidate sequence does not itself provide endpoints from which all the intervening values can be adequately approximated. We extend the length in such situations if the sequence meets a predetermined criterion that indicates that a subsequent pixel word may provide such a value. An example of such a criterion relates to the presence in the sequence of a pixel value that, in a sense that will be described later, is the sequence's "local maximum." If the other pixel values can be approximated by substituting the local maximum for the right endpoint value, we continue to lengthen the sequence even though it is not acceptable at its current length.

Another way of increasing average run length is to take gamma correction into account. As is well known to those skilled in the art, the pixel values typically stored represent the intensities to be obtained on the cathode-ray tube or other display device, but those intensities are exponentially, not linearly, related to the voltages that are applied to the device to achieve them. To achieve the desired intensities, therefore, a gamma-correction circuit is interposed between the palette memory (or decoder, in the case of a device employing the teachings of the present invention) and the display device. The gamma-correction circuit effectively performs the function $V=I^{1/\Gamma}$, where V is the output of the gamma-correction circuit, we is its input, and $\Gamma$ is a display-device-specific parameter, typically between 2 and 3.

As a result of this function, an input change is larger than the corresponding output change in some parts of the range and smaller in others. Therefore, a change in the commanded pixel value may cause no actual change in the voltage applied to the cathode-ray tube. We take this fact into account by accepting otherwise unacceptable sequences if their mix-approximated pixel values result in inputs to the cathode-ray tube that are no different from those that would result from a values that fall within acceptable limits.

Although the technique of the present invention provides good-quality renditions of most types of images, there are some images whose display, because of the limited capacity of the palette memory, is not initially acceptable. We have found that many such images can be satisfactorily displayed by simply re-running the encoding process with looser error criteria so that some of the previously rejected candidate sequences are accepted and the palette requirement is reduced.

By employing these techniques, it is possible greatly to extend the number of pixel values that a low-end display system can simultaneously display.

BRIEF DESCRIPTION OF THE DRAWINGS

These and further features and advantages of the present invention are described below in connection with the accompanying drawings, in which.

DETAILED DESCRIPTION OF AN ILLUSTRATIVE EMBODIMENT

Figure 1:
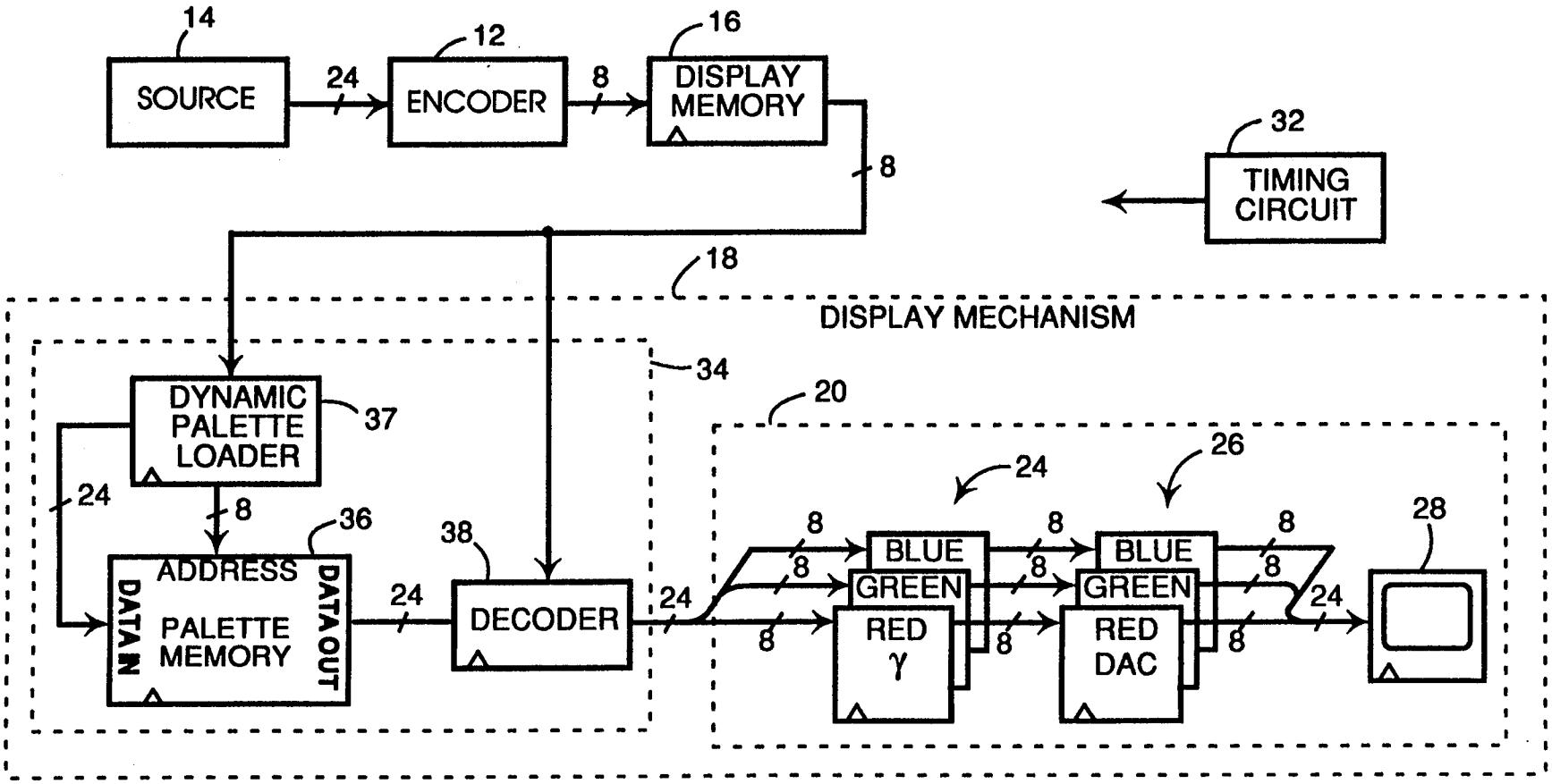
FIG. 1 is a block diagram of an image-display system that employs the teachings of the present invention.

FIG. 1 depicts a computer-display device distinguished by an encoder 12 that encodes an ordinary pixel-by-pixel representation of an image from a source 14 into a run-mix-coded representation. The encoder stores the resultant mix-run-encoded pixel words in a display memory 16. As a result, a display mechanism 18 of the type described in the '605 patent for anti-aliasing purposes can display an image whose data the source 14 supplies in a pixel-by-pixel form.

The display mechanism 18 employs a largely conventional image generator 20, which includes three gamma-correction circuits 24, typically in the form of read-only memories, for converting eight-bit pixel-value components into eight-bit representations of the cathode-ray-tube voltages required to achieve the intensities that those components represent. Each gamma-correction circuit 24 applies its output to a corresponding one of three digital-to-analog converters 26, which generate the control voltages for respective ones of the red, green, and blue electron guns of a color cathode-ray tube 28. The drawings illustrate a color version of the invention because, although its broader aspects can be applied in principle to monochrome displays, its benefits are most apparent in color apparatus.

As is also conventional, the system includes timing circuitry 32 for synchronizing the fetching of pixel words from the display memory 16 with the scanning of the cathode-ray tube 28. Circuit 32 provides synchronization or timing signals to all of the elements whose representations in FIG. 1 include timing-input carets.

A conversion mechanism 34 is interposed between the display memory 16 and the image generator 20 to convert eight-bit run-encoded outputs of the display memory 16 into pixel-value vectors, each of which is in the form of three eight-bit components. The conversion mechanism applies each component to a different one of the gamma-correction circuits 24. The Edelson '605 patent, which is hereby incorporated by reference, describes examples of such circuitry and the mix-run codes that they employ. Accordingly, we will only briefly discuss the mix-run code employed here. Before doing so, however, it may be beneficial to digress to an explanation of some of the nomenclature employed herein.

Pixel value as used herein means either the display of a given pixel—i.e., its color or shade of gray—or the vector (in the case of a monochrome display, the scalar) that explicitly defines that color or shade. The output of the conversion mechanism 34 is a pixel value because it defines the display of a pixel explicitly, but the output of the display memory 16 is not, because it identifies a pixel value only by reference to the contents of a palette memory. Typically, the output of the source 14 also comprises pixel values.

A pixel word is the image data for a single pixel. Thus, the output of the conversion mechanism 34 is organized in twenty-four-bit pixel words, while the output of the display memory 16 is organized in eight-bit pixel words. As is conventional, the display memory 16, which operates in synchronism with the scanning of the cathode-ray tube 28, operates as though it contained a separate location for each pixel on the cathode-ray-tube screen. In practice, storage in the display memory 28 is provided by a random-access memory whose smallest addressable unit may contain several pixel words, which are fetched from the RAM simultaneously but transmitted over the display-memory output lines sequentially. For most purposes, the effect is the same as though the separate pixel words were individually addressable, and location will accordingly be used to indicate a segment of memory that contains a single pixel word, even though it may not be separately addressable.

We now turn to the operation of the conversion mechanism 34. The conversion mechanism 34 includes a conventional palette memory 36, which is almost invariably a read/write memory, although the broader principles of the present invention would be applicable to an arrangement in which the palette memory is a read-only memory. A dynamic palette loader 37, whose operation will be described below, may additionally be used, although it is not needed to practice the broader principles of the present invention. For the time being, the dynamic palette loader can be thought of as merely forwarding the eight-bit output of the display memory to the 256-location palette memory 36 as its address. Each palette-memory location contains twenty-four bits, as was indicated above.

A decoder 38 receives the palette-memory output as well as the output of the display memory 16. So long as the display-memory output does not have a value between 191 and 223, the decoder 38 merely forwards the palette-memory output to the gamma-correction circuits 24. In the absence of those display-memory outputs, therefore, the display mechanism 18 operates in the conventional manner, with two exceptions. The first is that the synchronization of the components is offset enough that the decoder 38 can delay the forwarding of the palette-memory output word resulting from a given display-memory output word until the decoder has had an opportunity to inspect the subsequent word. The second is that if the subsequent word has a value between 191 and 223, the decoder 38 does not forward the palette-memory output for the given word. Instead, it repeats the palette-memory output for the word that preceded it, for purposes that will now be explained.

The decoder 38 treats display-memory outputs between 191 and 223 as opcodes. In some embodiments, it may treat a display-memory output of 191 as a command to change palette-memory contents in a manner that will be discussed below. It treats a display-memory output whose value is between 192 and 223 as a command to compute a mix of the palette-RAM outputs that resulted from the last two non-opcode display-memory outputs. It interprets the five least-significant bits of such a command as an indication of the mix.

Specifically, each display-memory output y between 192 and 223 represents a fraction m such that $$m_n=(y_n-192)/32.$$

This fraction $m_n$ results in computation of a vector mixture $M_n$ of the vectors $X_1$ and $X_2$ that result from the last two non-opcode display-memory outputs $x_1$ and $x_2$. That is, $$M_n=m_nX_1+(1-m_n)X_2.$$

A typical sequence of display-memory outputs and the resultant outputs of the conversion mechanism 34 is as follows:

$$x_1 \quad x_2 \quad y_3 \quad y_4 \quad y_5 \quad y_6 \quad x_7$$
$$X_1 \quad X_1 \quad M_3 \quad M_4 \quad M_5 \quad M_6 \quad X_7,$$

where $x_n$ is a non-opcode output and $y_n$ is an opcode output that represents a mix. An inspection of this sequence reveals that the conversion mechanism merely forwards the palette-memory contents $X_1$ of the location that the first non-opcode display-memory output $x_1$ addresses. The reason for this is that the decoder 38 has looked ahead and seen that the next output $x_2$ of the display memory is also a non-opcode word. However, in response to display-memory output $x_2$, the conversion mechanism 34 merely repeats the $X_1$ output. As will be explained below in more detail, the reason for this is that the $x_2$ output is followed by an opcode output $y_3$, and any opcode that follows a non-opcode word indicates that the encoding process has placed into the display-memory location containing the non-opcode value the address of a palette-RAM entry that represents, not the pixel value to be displayed in the corresponding pixel, but the value to be displayed at the other end of the "run" of values represented by mixes.

Reflection reveals that this arrangement requires the display of every run to begin with two identical pixel values. This may seem to detract significantly from the flexibility of the mix-run coding scheme; it is not possible to start a run unless two adjacent pixels are identical. In practice, however, this is only a minor limitation, since identical or nearly identical adjacent pixels occur very frequently in most natural images. Moreover, not all mix-run codes require the existence of identical adjacent pixels. As the Edelson '605 illustrates, other mix-run-encoding schemes employ pixel words that include both a mix and a pixel value so that reference to only one other pixel word, and not two, is necessary to produce the desired mixture. Such an arrangement does not require identical adjacent pixels, and the principles of the present invention can also be practiced with such encoding schemes.

The operation of the synchronous part of the apparatus, namely, of the elements downstream of the decoder 12, is largely the same as that described in the '605 patent for eliminating aliasing at edges in computer-generated images. According to the present invention, however, the same mechanism can be employed to display natural images, which may be stored as actual pixel values.

The advantage of this invention can be appreciated by computing the range of pixel values that such an arrangement is capable of producing. Of the 256 possible display-memory outputs, thirty-three are opcodes. This leaves 223 palette values. The number of combinations of 223 values in pairs multiplied by thirty-two different mixes and divided by two for duplication yields over 790,000 different simultaneously available values. Clearly, this is several orders of magnitude greater than the range (256) available in a conventional eight-bit system. Moreover, although this range is only around five percent of the range that is available in the (much more expensive) units that store complete three-component pixel values in the display memory, the resultant difference in subjective image quality is usually small, and much of even that difference can largely be eliminated in most instances by dynamic palette loading—i.e., changing palette contents in the middle of a scan—in a manner that will be described below.

In order to display such images in a mix-run-encoded manner, the present invention employs the encoder 12. Unlike the circuitry downstream of it, the encoder 12 would not have to operate in real time and would typically be embodied in a general-purpose processor, such as one found in a personal computer or workstation, although appropriate dedicated hardware may make it possible to perform its functions on a real-time basis. It would operate on images originally stored in a pixel-by-pixel form in a less-expensive, lower-speed medium such as a magnetic disk, CD ROM, or optical disk.

It should be emphasized that FIG. 1 segregates the various system elements for ease of explanation; it does not depict their usual grouping in circuit boards and integrated circuits. In practice, the timing circuit 32 would typically be provided in a video/graphics ("VGA") controller board of the type conventionally employed in personal computers. That same board would typically be used to convey the encoder output to the display memory 16, to apply to the display memory 16 the read/write, strobe, and address signals, not represented in the drawing, necessary for storing data in and fetching data from the display memory 16, and to forward the fetched data as addresses to the palette memory 36. The VGA controller would also provide the palette memory 36 with the read and strobe signals necessary for normal real-time operation, and it would supply it also with the strobe, data, and write signals required for initial palette loading under encoder (i.e., microprocessor) control.

The palette memory, and digital-to-analog converters are typically provided on a single "RAM-DAC" chip in conventional display apparatus. In order to interpose the dynamic palette loader 37 and decoder 38, whose arrangement is described in U.S. patent application Ser. No. 07/452,022, of Edelson et al. for a Dynamic Palette Loading System for Pixel-Based Display, filed Dec. 19, 1989, and incorporated herein by reference, one may provide the palette memory 36 on a chip separate from the digital-to-analog converters 26. However, we prefer to fabricate a single chip comprising the palette memory 36, dynamic palette loader 37, decoder 38, and digital-to-analog converters 26 because such a chip can be made as a plug-to-plug-compatible replacement for a conventional RAM-DAC chip.

Figure 2A:
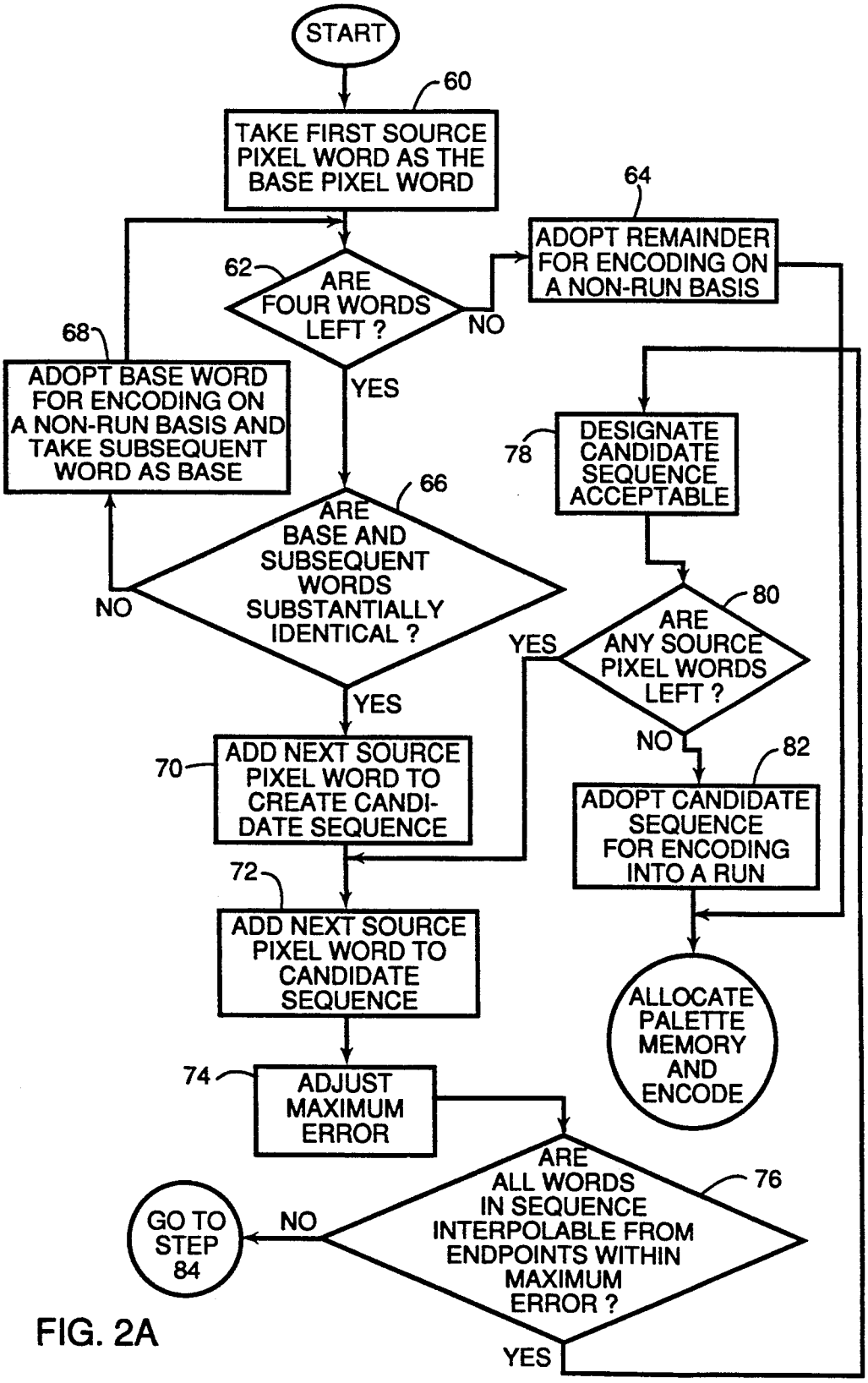
FIG. 2 is a flow diagram of the technique employed by the system to convert the image data from a pixel-by-pixel-code to a mix-run-code form.
Figure 2B:
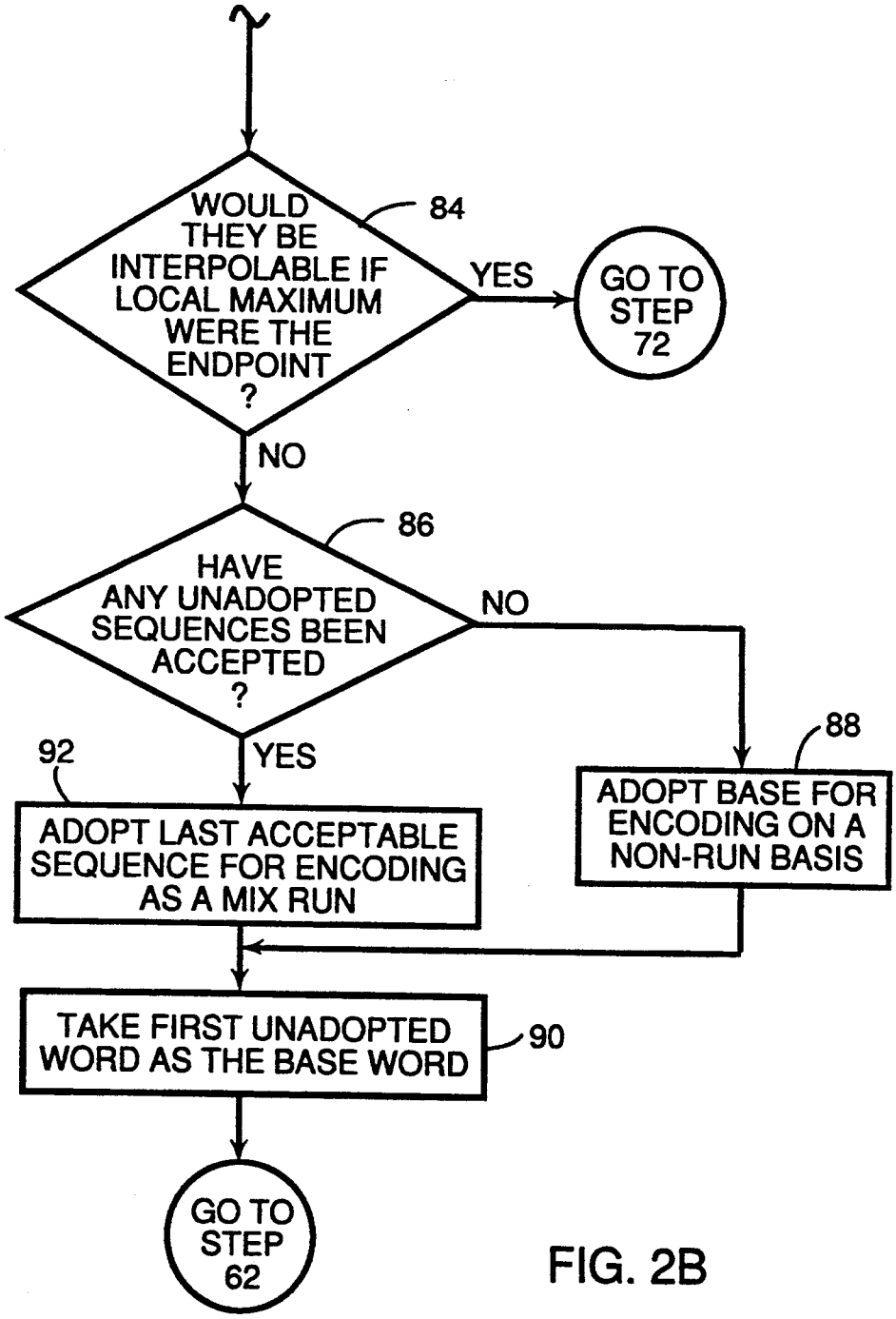

The encoder 12 operates in a manner that will be described in connection with FIG. 2. The overall approach of the routine of FIG. 2 is to identify a source pixel-word sequence whose beginning and end words represent values that can be interpolated to approximate all of the pixel values represented by the intervening pixel words. The sequence is then lengthened repeatedly by one pixel until the lengthened sequence no longer meets this criterion. The routine then returns to the last acceptable sequence, adopts it for subsequent encoding as a mix run, and repeats the procedure with subsequent pixel words.

The routine of FIG. 2 begins with step 60, in which the routine starts with the first pixel word in the image that it receives from the source 14. In step 62, the routine determines whether that word is followed by at least three words to make a four-word sequence. Although a run could in theory consist of only three pixel words, we require four in practice because no savings in palette-memory capacity results from a run of three: if the first two words are identical, the three words in the run would require only two palette entries without mix-run encoding. If four words are not left, therefore, the routine adopts the three or fewer remaining words for encoding on a non-mix basis, as block 64 indicates; that is, the subsequent encoding process will place non-opcode codes in the corresponding display-memory locations. The routine of FIG. 2 then ends, and the palette-memory allocation and actual encoding starts.

If four words are left, the routine determines in step 66 whether the first two words are either identical or near enough to being identical that displaying them identically would not be objectionable; as was indicated above, every run in the chosen mix-run code starts with two identically displayed pixels. If the first two words differ by too much, they cannot begin a run, and step 68 adopts the first one for encoding on a non-run basis. That is, the current pixel word will neither be stored as an opcode nor used as one of the operands in a mix operation. The routine then advances through the image by one source pixel word and returns to step 62.

On the other hand, if the routine does find a sequence of two new pixel words representing nearly identical pixel values, it proceeds to step 70 to add a third word to the identical two to form a candidate sequence, and it then adds a fourth in step 72.

The resulting candidate sequence is now ready to be tested for suitability for encoding into a mix run. First, the routine adjusts a maximum error. This maximum error is the criterion that will be used to determine whether interpolation between palette values can adequately approximate the pixel values in the source image. According to the invention, the routine adjusts this criterion so that it varies with candidate-sequence size. The criterion starts out as a relatively high percentage error; that is, the routine determines the ratio of the error to the magnitude of the source pixel value, and the result is compared with the maximum-error criterion. As the size of the candidate sequence increases in subsequent passes through the loop, the maximum-error criterion decreases to a smaller percentage and then becomes a small absolute magnitude.

As the output-run size increases, therefore, the approximation must be increasingly good. We have found that this approach tends to increase the subjective quality of the resultant display for a given available palette size. For a four-word-long run, we use an error criterion of 12%; that is, every mix-computed pixel value must be within 12% of the corresponding source pixel value if the run is to be acceptable. This maximum-error criterion is gradually reduced until it reaches 4% at a run length of ten. For run lengths that exceed ten, we employ absolute-error values. That is, we apply the 4% value to the average of each component over the pixel values already in the candidate sequence, and we gradually reduce the resulting absolute-error value for each component until it reaches zero at a run length of 15.

The next step, represented by decision block 76, is to determine whether the pixel values represented by all of the intervening words in the candidate sequence are interpolable from the values represented by the first and last pixel words in the sequence. Clearly, there are many ways of defining the error, and the particular choice is not critical. The one that we use is as follows. Assume that the candidate sequence consists of pixel words that represent a first pixel value $X_F$, a last pixel value $X_L$, and intervening pixel values $X_i$, where each pixel value X is a vector ($x_R$, $x_G$, $x_B$). The criterion that we apply for an absolute error is that there must be an integer n between 0 and 31, inclusive, such that $$E_R < E_{Rmax},$$

$$E_G < E_{Gmax}, \text{ and}$$

$$E_B < E_{Bmax},$$

where $$E_R = |nx_{FR} + (32-n)x_{LR} - 32x_{iR}|/32$$

and $E_G$ and $E_B$ are similarly defined.

For a percentage error, $E_{Rmax}$, $E_{Gmax}$, and $E_{Bmax}$ are fractions rather than absolute errors, and the criteria become:

$$E_R < E_{Rmax}x_R,$$

$$E_G < E_{Gmax}x_G, \text{ and}$$

$$E_B < E_{Bmax}x_B.$$

If the candidate sequence meets these criteria, the routine recognizes it as acceptable for encoding into a mix run, as block 78 indicates, and the routine advances to step 80, in which it determines whether the end of the image has been reached. If so, the routine adopts the candidate sequence as one that will be encoded into a mix run, as block 82 indicates, and the process ends. Otherwise, the routine returns to step 72 to add another pixel word and repeat the operation, possibly with a lower maximum-error value $E_{max}$. This operation continues, with a new source pixel word added on each passage through the loop, until the routine runs out of source words or the lengthened sequence fails to meet the maximum-error criterion.

If the lengthened sequence fails to meet the maximum-error criterion, the routine proceeds to an optional step represented by block 84 if the particular embodiment employs that step, which is described in more detail below. If that step is omitted, the routine proceeds directly to step 86, in which it determines whether any acceptable sequence of source pixel words has been identified but not adopted; that is, it determines whether it has identified any acceptable sequence that starts with the current base word. If not, the routine stops trying to form an acceptable sequence with the current base word: it adopts the current base word for coding on a non-run basis and adopts the next word as a new base word, as blocks 88 and 90 indicate. If it has found one or more such acceptable sequences, on the other hand, it adopts the last (longest) one not yet adopted for encoding a mix run, as block 92 indicates, and the word following that adopted sequence becomes the new base word.

The routine then returns to step 62 and begins the process again. The process repeats until all words have been adopted for encoding, either on a non-mix basis or as part of a mix run.

We now return to block 84, which imposes a criterion that was not described above. The routine as described so far works well for a wide variety of images. However, there are certain images, typically of the type that appear "textured," that tend to result in a large number of short runs. These rapidly exhaust the palette-memory capacity. We have found, however, that the average run length in such images can usually be increased significantly by employing a procedure such as that exemplified by step 84. The routine enters step 84 when the candidate sequence has failed to meet the criterion imposed by step 76, namely, that its endpoints provide values from which the values of its intervening pixels can be interpolated.

The purpose of step 84 is to test for an indication that, although the intervening values can not be interpolated from the current endpoints, lengthening the sequence may result in endpoints from which they can. This indication is based on a "local maximum" within the candidate sequence. A given source pixel word represents a local maximum of a sequence if the red, green, and blue components of all of the other pixel values in the sequence are between the respective red, green, and blue components of the given pixel value and the first pixel value in the sequence.

The step of block 84 determines, first, whether such a local maximum exists and, second, whether the other pixel values are additionally interpolable between the first pixel value and the local maximum. If so, the routine proceeds to determine whether an acceptable candidate sequence can be found by lengthening the sequence, even though the candidate sequence is not acceptable at its present length.

It should be noted that a sequence can meet the criterion of step 84 only if it includes a local maximum. Yet the presence of a local maximum is not a necessary condition for the existence of further pixel values that will result in an acceptable sequence; that is, lengthening a candidate sequence may convert it into an acceptable sequence even if it does not have a local maximum. We stop lengthening the candidate sequence when it fails to meet the criterion of step 84 only because that criterion is simple to apply.

But other criteria can also be employed to determine whether it is worthwhile to lengthen an unacceptable sequence in the hopes of finding an acceptable one. One method is simply to consider all of the pixel values as points in a three-dimensional space and then solve for the line that results in the least-squares error between those points and line. If all of the points fall within a maximum-error distance from the line, and if each component of the left endpoint value is either greater or less than all of the corresponding components of the other values in the sequence, then it is possible that a further value will be found from which the intervening values are interpolable. For reasons of algorithmic simplicity, we have not chosen such a criterion, but that or a similar one can readily be substituted for the one represented by block 84 of FIG. 2.

It should also be noted that the foregoing discussion is based on the assumption that all sequences adopted for encoding as runs will be encoded with the sequence endpoint values chosen as the characteristic values of the resultant run, i.e., chosen as the palette entries to which the first two pixel words of the run point. However, suppose the routine of FIG. 2 were modified to pass to the encoding process not only the identification of each source sequence to be encoded into a run but also a separate indication of what the run's second characteristic value should be. That is, suppose that the encoding process did not automatically adopt the right-hand endpoint as the second characteristic value. In such an arrangement, any sequence that satisfies the step-84 criterion could be considered acceptable, and the value passed to the encoding process for such a sequence would be its local maximum. Indeed, even in the absence of a local maximum, a sequence that satisfied the alternate, least-squares criterion mentioned above could be adopted by using a value not in the sequence as the second characteristic value. In both cases, the last mix code would not in general represent $32/32=1$.

A technique for slightly reducing the stringency of the criteria imposed in steps 66, 76, and 84 without reducing the resultant image quality at all results from a recognition that the non-linear behavior of the gamma-correction circuitry results in a bunching-up of values. Suppose that, in step 66, the values represented by two adjacent pixel words are identical in all but their green components, which have respective values of 250 and 251. If the criterion imposed in step 60 were that the two beginning values must be strictly identical, those two adjacent values would not meet the criterion, so they could not be the start of an acceptable sequence.

TABLE I

| Pixel-Value Component | Resultant DAC Input |
|---|---|
| 0 | 0 |
| 1 | 23 |
| 2 | 31 |
| 3 | 37 |
| . | . |
| . | . |
| . | . |
| 250 | 253 |
| 251 | 253 |
| 252 | 254 |
| 253 | 254 |
| 254 | 255 |
| 255 | 255 |

However, Table I illustrates the correspondence between pixel-value components and the resulting values that the gamma-correction circuits 24 apply to the digital-to-analog converters 26, and it shows that the difference in nominal pixel values 250 and 251 makes no difference in the resultant image; the digital-to-analog converter inputs that result from both values are the same. Accordingly, step 60 can be modified to consider different pixel values identical if their resultant gamma-corrected values are the same. Similar modifications can be made to steps 76 and 84.

After each of the source pixel words has been adopted for encoding—either on a non-mix basis or as part of a mix run—the encoder allocates the palette memory before it performs the actual encoding; it is necessary to know the locations of the various pixel values in the palette memory before palette-memory addresses are used as part of the mix-run code words.

The allocation can be performed in many ways. One way that we have considered starts with a division of the three-dimensional ($256\times256\times256$ in the illustrated embodiment) pixel-value space into sixty-four equal zones by dividing each component range into four equal parts. A palette-memory location is then allocated to the most frequently occurring endpoint value in each zone. This step uses at most sixty-four locations; if some zones are empty, it uses fewer than sixty-four. Starting with this step improves the rendition of small features that have unique colors. The remaining usable locations can then be allocated in any appropriate manner among the remaining distinct endpoint values. In many cases, the number of remaining endpoints will exceed the number of remaining palette-memory locations. In such cases, the remaining palette values should be chosen in accordance with a method that tends to minimize the error that results from endpoint approximation. For instance, we employ the "median-cut" approach described in Heckbert, "Color Image Quantization For Frame Buffer Display," *Computer Graphics*, 16, 3, (July 1982), pp. 297–307.

After the allocation procedure has been completed, the actual generation of the mix-run code begins. Specifically, the display-memory locations corresponding to all pixels that have been identified as mix-run endpoints are loaded with the palette-memory addresses of the palette-memory locations that contain either their respective source pixel values or the palette values closest to those pixel values. The locations for all non-endpoint pixels that do not contain dynamic-palette-loading sequences are then loaded with the appropriate mix codes. The system can then display the image.

We use the foregoing approach if the palette is fixed throughout the display of the image. However, we prefer to load the palette dynamically, i.e., to change its contents during the display of the image. To do this, we employ the dynamic palette loader 37, which comprises circuitry of the type described in the copending Edelson et al. application mentioned above.

As was indicated above, the dynamic palette loader 37 ordinarily just forwards the output of the display memory 16 to the palette memory 36 as its address. The only exception to this occurs when the display-memory output has been 191, which is a command to begin dynamic palette loading. When the dynamic palette loader 37 receives this code, it interrupts the reading of the palette memory 36. At the same time, the decoder 38, which also receives code 191, does not forward the current palette-memory output. Instead, it repeats the last palette-memory output for five pixel-word times, which is the duration of the operation that the dynamic palette loader 37 performs in response to reception of code 191.

When the dynamic palette loader 37 receives this code, it temporarily retains in internal registers the contents of the next three pixel words, which respectively represent the red, green, and blue components of a pixel value to be stored in the palette memory 36. In response to receipt of the fourth pixel word, the dynamic palette loader 37 loads the retained pixel value into the palette-memory location whose address the fourth subsequent pixel word represents. The dynamic palette loader 37 and decoder 38 resume normal operation with the fifth subsequent word so long as that word is not 191.

Figure 3:
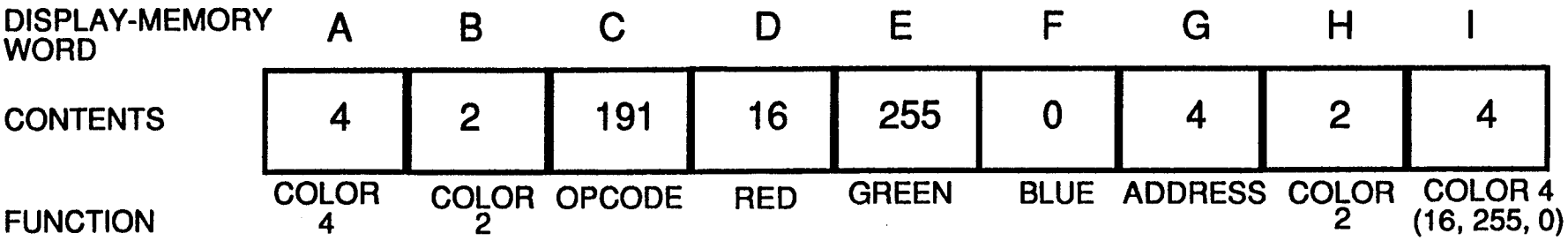
FIG. 3 is a diagram of a typical sequence of mix-run-code pixel words that includes a dynamic-palette-loading code.

FIG. 3 depicts a succession of mix-run-code pixel words that includes a dynamic-palette-loading sequence. Display-memory pixel words A and B are non-mix codes that represent the pixel values by designating the palette-memory locations 4 and 2 at which they are stored in the palette memory. Word C is the dynamic-palette-load opcode, 191. Words D, E, and F contain the values of the red, green, and blue components, respectively, of the pixel value to be stored in the palette memory, while word G represents the address, namely, 4, of the palette-memory location into which the pixel value is to be stored. Accordingly, the dynamic palette loader 37 loads pixel value (16, 255, 0) into palette location 4, overwriting the value previously stored there. At word H, five words have occurred since opcode 191, so the decoder stops repeating the last pixel value and instead forwards the pixel value in palette-memory location 2, to which word H points. Word I points to palette location 4, so the decoder produces pixel value (16, 255, 0), the value just loaded.

Figure 4:
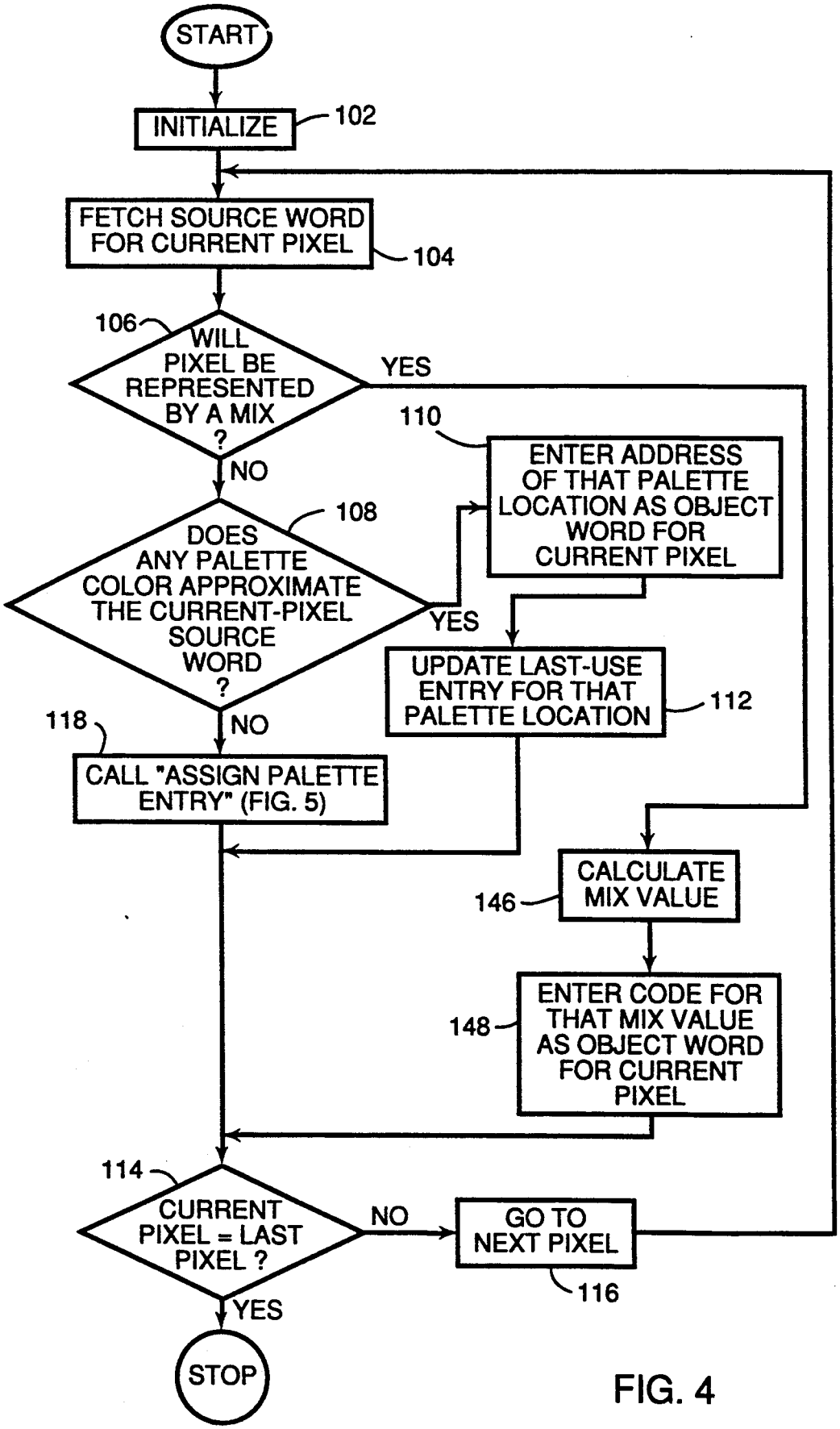
FIG. 4 is a flow diagram of the main loop of the routine that the system uses to incorporate palette-memory addresses and dynamic-palette-loading commands into the display-memory data.
Figure 5A:
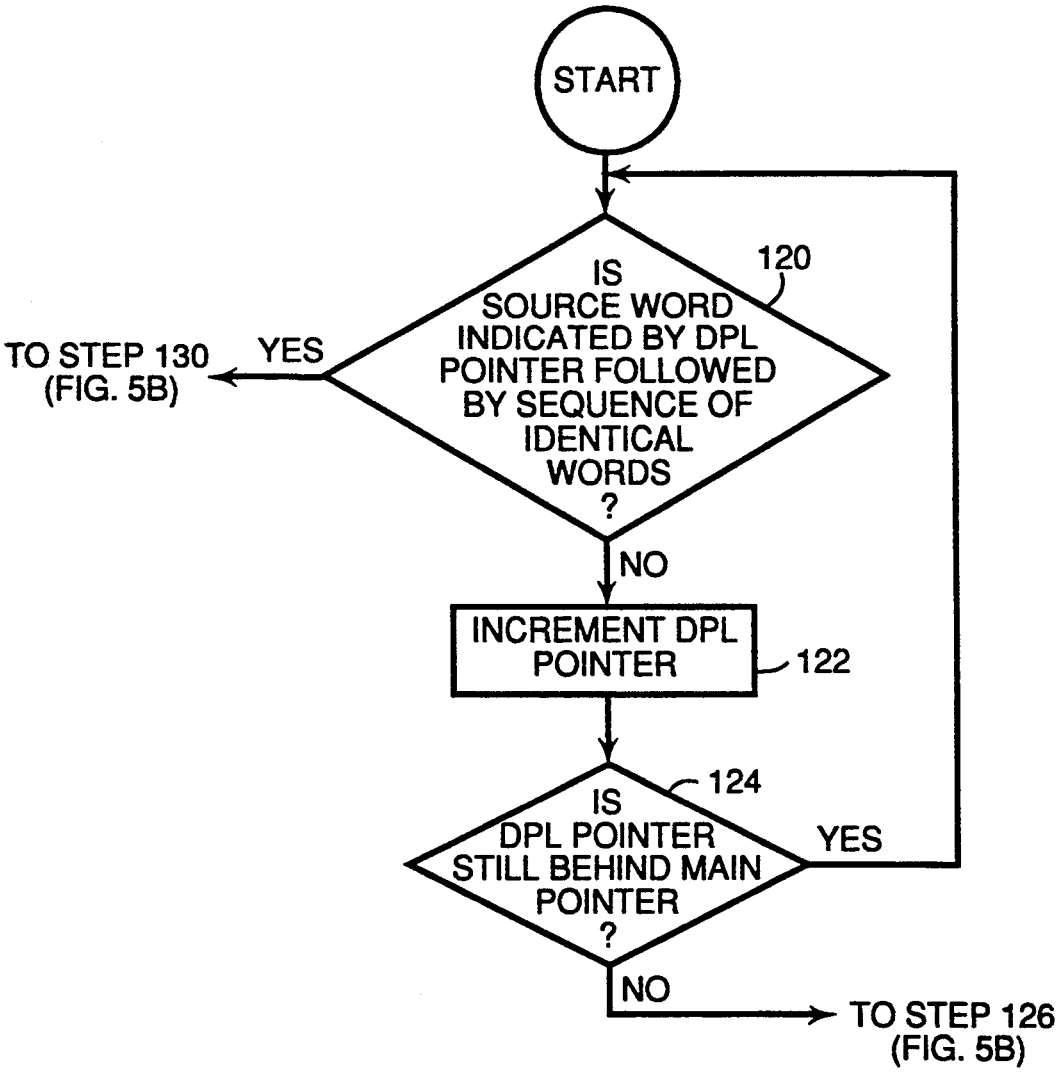
FIGS. 5A and 5B form a flow diagram of a subroutine that the main loop of FIG. 4 calls.
Figure 5B:
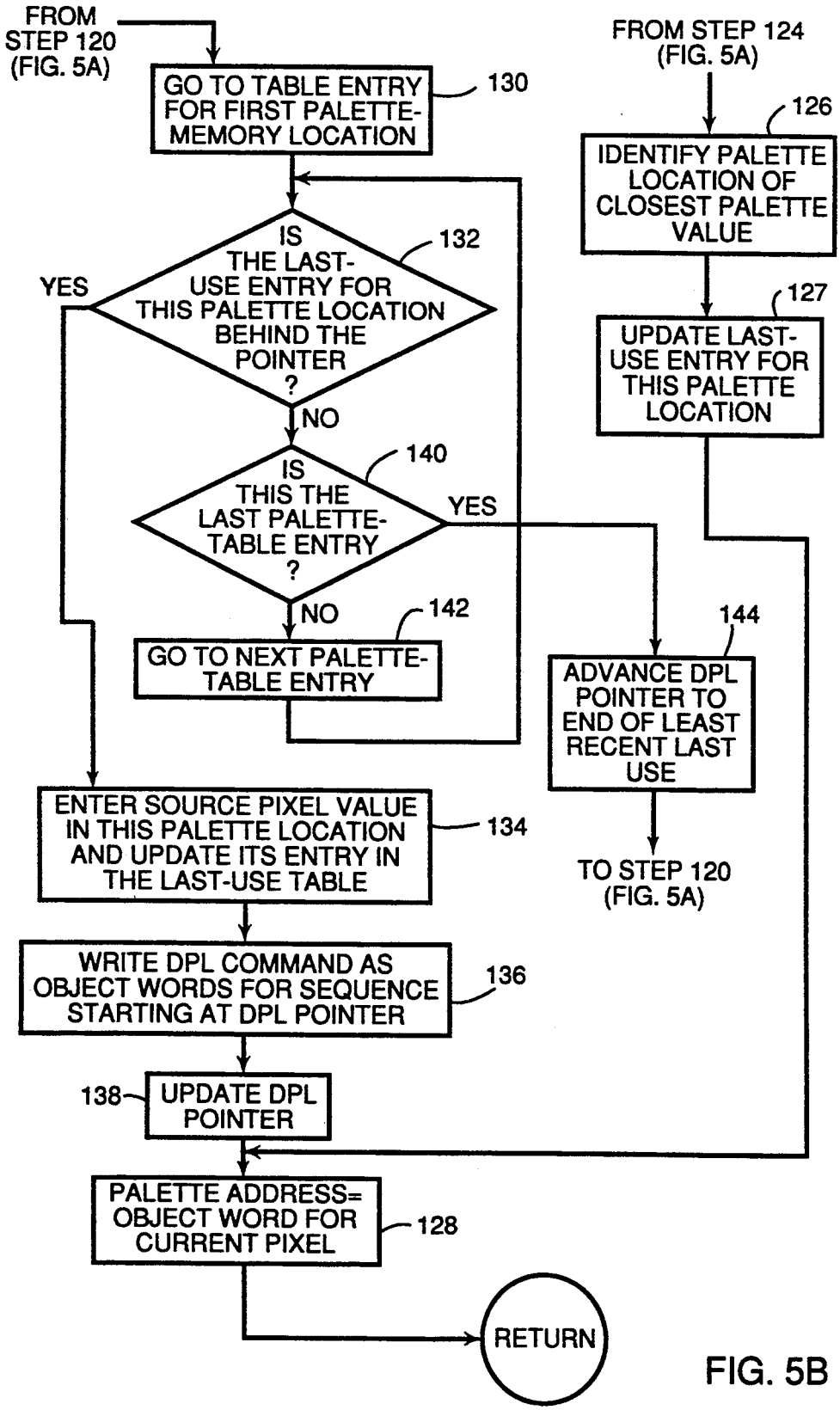

In a system that employs dynamic palette loading, the encoder employs a routine such as that depicted in FIGS. 4 and 5 to convert source pixel data into display-memory contents that include palette-address-codes and commands that take advantage of the dynamic-palette-loading capability. This routine operates on the results of a first pass of the type depicted in FIG. 2, in which the mix runs have been identified but the mixes preferably have not yet been calculated. The reason for delaying the calculation of the mixes is that they will depend somewhat on the palette-memory contents, which it is the purpose of the second, palette-loading pass of FIGS. 4 and 5 to determine. In the context of encoding for dynamic palette loading, therefore, the "source pixel words" are the output of the mix-run-encoding pass.

The encoder determines the locations and contents of dynamic-palette-loading sequences through the use of a running table of last-use values for each location in the palette memory that will be subject to dynamic palette loading. Specifically, the routine proceeds through the image in the raster-scan order to assign palette-memory addresses to the various pixel words in the image. Each time it does so, it updates its last-use entry for the palette location that it uses so that the last-use entry designates the image location of that palette location's most-recent use.

The purpose for keeping such a table will be explained below in connection with FIG. 4. The routine of FIG. 4 employs this table as well as two pointers. The main pointer gives the location of the pixel whose source pixel value the routine is currently attempting to approximate with a palette value. The second pointer is a "DPL" (dynamic-palette-loading) pointer, which points to the end of the last dynamic-palette-loading sequence. The DPL pointer represents the point from which searching for a DPL site in the image can resume; as will become apparent from the discussion of FIG. 4, no DPL sites that can still be used precede the DPL pointer.

The first step in the routine that FIG. 4 depicts is represented by an initialization block 102. Most of the actions that this step represents comprise setting to initial values the tables and counters that the routine uses. The initialization step also includes actions taken to insure that the palette-memory contents—which change during the course of a scan in response to the display-memory contents—do not have different contents when they are called at corresponding points in different scans of the same image.

One way to insure consistent results would be to reset the palette memory to an initial set of contents during every vertical retrace. Such an approach can work perfectly well in a dynamic-palette-loading system, but we prefer to perform the initialization in another manner, one that employs the dynamic-palette-loading mechanism itself and thus minimizes the hardware and software accommodations that must be made in order to carry out dynamic palette loading.

The approach that we employ here is to set the contents of the first two lines of the source image to black; that is, we remove the information content of what is typically an unimportant part of the image and replace it with a border. The result is to provide two full lines of dynamic-palette-loading sites, since all of the pixel values in those two lines are now identical. The said result could be achieved by placing the border at the bottom or by putting one black line at the top and another at the bottom. As will become apparent, these dynamic-palette-loading sites will then be used to provide an initial set of palette-memory contents that are always the same at the beginning of the information-containing part of the display.

Other initialization steps will be described below as their purposes become apparent.

Block 104 represents fetching the source word for the current pixel, i.e., the one that the main pointer identifies. If, as was suggested above, a black border has been provided on the first two lines, the routine may skip the first two lines, and the initialization step will have set the main pointer to the beginning of the third line, although no harm would result from having set it to the first location in the first line. The routine examines the fetched source word, as block 106 indicates, to determine whether that source word represents a pixel value or a mix. If the source pixel word is not a mix, the routine proceeds to step 108, in which it searches a table representing the "current" contents of the palette memory, i.e., the contents that the palette memory is to have at that point in the scan; in addition to the last-use table, the routine maintains a contents table, which represents the "current" palette-memory contents. The routine determines whether any palette entry approximates the current pixel's source value within an acceptable tolerance. As will be explained below, this tolerance may be fixed, or it may vary in accordance with the contents of the image.

In any event, if the routine is to cause the first two, border lines of the display to fill the palette memory properly by dynamic palette loading, it is important that no palette-memory location subject to dynamic loading be found in step 108 to have acceptable contents that have not resulted from dynamic palette loading in the border region or subsequent thereto. For this reason, the initialization will typically employ some step to assure this result. One way to do so is to maintain in-use flags for the palette-memory locations to indicate whether the routine has yet given them values by dynamic palette loading. Step 108 would then examine only those palette-memory locations whose in-use flags are set.

If the result of step 108 is positive, i.e., if there is an existing palette entry that adequately approximates the current source pixel value, the routine proceeds to step 110, in which it places the palette-memory address of that entry into the display-memory location corresponding to the current pixel. The routine then updates the last-use entry for that palette-memory location. That is, the last-use entry for that palette-memory location is set to value that indicates that the palette-memory location was used at the point in the image that the main pointer currently specifies. As will be seen below, this will prevent a dynamic-palette-loading operation from changing the contents of that palette-memory location before it can be used to display the pixel currently being encoded.

The routine then proceeds to step 114, in which it determines whether all of the pixels in the image have been examined. If so, of course, the routine stops. Otherwise, the routine advances the main pointer to specify the next pixel, as block 116 indicates, and starts again with step 106.

If step 108 determines that the existing palette-memory contents do not approximate the current source pixel values, the routine proceeds to the ASSIGN PALETTE ENTRY subroutine represented by block 118 and shown in more detail in FIG. 5. The purpose of this subroutine is to attempt to find a DPL site that precedes the current pixel so that a DPL command can be used to load the palette memory with contents that adequately approximate the intended value for the current pixel.

As was mentioned before, the dynamic-palette-loading routine employs a DPL pointer as well as a main pointer. The DPL pointer typically specifies a location somewhat behind the location that the main pointer specifies, and it represents the place in the image data at which the routine will next resume its search for a DPL site, i.e., for a site in which it can replace the normal object code words with a DPL command. Step 120 determines whether the source word that the DPL pointer specifies is followed by a long enough sequence of identical or, in some embodiments, nearly identical source words. The reason for this, of course, is that the display system displays a sequence of identical pixel values at locations in the display for which the display memory contains DPL commands. Therefore, a sequence of pixel words that meets the step-120 criterion is a potential DPL site.

Initially, the output of step 120 is always yes; the first two lines have been set to all black, so all pixel words are identical in the first two lines. After the first two lines, however, this test is typically failed more often than not, and the routine proceeds to step 122, in which it increments the DPL pointer. Then, in step 124, the routine determines whether the pixel sequence that the DPL pointer specifies still precedes the pixel that the main pointer specifies. If it does not, then a command placed at that site cannot change the palette-memory contents in time to affect the display of the pixel that the main pointer specifies.

If the DPL pointer does not meet the criterion imposed by step 124, therefore, the routine must accept the closest existing palette value, so the routine proceeds to step 126, in which it identifies the palette-memory location whose contents most closely approximate the intended pixel value, even though the approximation does not meet the acceptability criteria initially imposed by step 108. After step 127, in which the routine updates the last-use entry of the selected palette location to indicate that it was last used at the current pixel, the routine adopts the selected palette-memory address as the object word for the current pixel, placing it into the appropriate display-memory location. Block 128 represents this step. The subroutine then returns control to the main loop of FIG. 4, which proceeds to the next pixel.

If the DPL pointer does meet the step-124 criterion, on the other hand, then a DPL command at the pixel sequence that the DPL pointer specifies can affect the current pixel. The routine accordingly returns to step 120, in which it again searches for a sequence of identical pixels. The length of the sequence for which it searches may be either five or six in the illustrated embodiment. If the sequence that the DPL pointer specifies is immediately preceded by a DPL command sequence, the pixel value displayed during the second DPL command is the same as that displayed during the first, so only five identical values are needed to accommodate the second DPL command, whereas six are required ordinarily.

In either case, if the sequence of source pixel words passes test 120, the routine begins the process of determining whether any palette-memory contents can safely be changed by a DPL command at the site that step 120 has identified. Step 130 represents beginning inspection of the last-use table with the entry for the first palette-memory location that is subject to dynamic palette loading.

In principle, all of the 223 palette-memory locations actually employed for look-up-table purposes in the illustrated embodiment could be "subject to dynamic palette loading." In practice, however, we reserve the first palette-memory location for a fixed value representing black, and we do not permit its value to be changed by dynamic palette loading. This is beneficial in our arrangement because of our particular initialization approach, but other dynamic-palette-loading approaches would not necessarily require such a fixed value. In order to prevent any change in the first, black-containing location, the "first" palette-table entry referred to in step 130 in our arrangement is actually the second overall location, but it is the first one that is subject to dynamic palette loading.

In step 132, the routine consults a last-use table entry to determine whether the corresponding palette-memory location needs to be used between the image locations identified by the DPL and main pointers. That is, the purpose of step 132 is to insure that the routine does not change a palette entry on which an intervening object-word assignment is based. A positive result of test 122 indicates that there is no intervening use of the subject palette-memory location, and the routine accordingly proceeds to step 134, in which it changes the contents-table entry for that location to the pixel value that is intended for display at the current pixel location, i.e., at the pixel, identified by the main pointer, whose object word the routine is currently determining. This changes the last-use location for that palette-memory location, and step 134 also includes updating that location's last-use field to indicate that its last use so far occurs at the current pixel.

The routine then proceeds to step 136, in which it places the appropriate dynamic-palette-loading command into the sequence of display-memory locations that begins with the one that the DPL pointer identifies. That site can accordingly no longer be used for further dynamic-palette-loading commands, so the routine advances the DPL pointer to the end of that command sequence, where the next search for a DPL site will begin. Block 138 represents this step. The routine then proceeds to step 128, in which it writes the address of that palette location into the display-memory location that the main pointer specifies. As before, control returns to the main loop of FIG. 4.

We now return to step 132. A negative result of the test of step 132 indicates that the palette location being examined has already been chosen for use at a display pixel that follows the identified DPL site. The contents of that palette location accordingly cannot be changed at the chosen DPL site, so the routine proceeds to step 140, which determines whether all of the palette-memory locations have already been examined. If they have not, the routine goes to the last-use entry for the next palette-memory location, as block 142 indicates, and repeats the test of step 132. This continues until the routine finds a palette-memory location that has not so far been chosen for use beyond the identified DPL site, at which point the routine proceeds to step 134 and continues as before.

However, if the routine runs out of palette-memory locations without finding one that can safely be changed by a command at the identified DPL site, the result of the test step 140 is positive, and the routine rejects the identified DPL site and looks for one further on in the image. Specifically, as block 144 indicates, the routine searches through the last-use entries for all of the palette-memory locations, finds the earliest one, and increments the DPL pointer to a value that identifies a pixel just beyond the last use indicated by the earliest last-use entry. In other words, the routine identifies the least recently used palette-memory location and directs the search for a DPL site to begin just after the last use of that palette-memory location. The search for a DPL site then begins again at step 120.

A few observations are in order concerning step 126, in which the routine selects the closest palette entry even though the palette entry does not approximate the intended value within the tolerance allowed in step 108. It is clearly preferable that the routine never reach this step, since it represents a departure from the fidelity standards otherwise imposed.

The number of instances in which the routine must resort to this expedient can usually be reduced by reducing the general fidelity requirement, i.e., by loosening the tolerances imposed by step 102. This reduces the rate at which the DPL sites are used. Resort to step 126 can also be reduced by increasing the number of DPL sites, either by loosening the "identical" requirement of step 120 or by cropping the image with single-color side borders. But images differ in the number of colors they require and the number of DPL sites they provide, and a fidelity sacrifice required in one image may be unnecessary in another. In order to reduce the number of instances in which the routine must resort to step 126—yet maintain as high a general level of fidelity to the source image as possible—the routine described so far can be refined so that its tolerances vary in accordance with the image being adapted.

One way to do this is simply to run the encoder, display the resulting image to a user, and allow him to adjust the tolerance imposed by step 102, step 120, or both or to add borders and adjust their width in order to optimize the subjective quality of the image. In order to reduce the amount of human intervention needed, however, provisions could be made to adjust the routine parameters automatically.

For instance, the search for a DPL site, which is now part of the ASSIGN PALETTE ENTRY routine of FIG. 5 at steps 120–124, could be inserted into the main loop of FIG. 4 between steps 106 and 108. This would make available to the approximation test of step 108 an indication of the distance between the next available DPL site and the current pixel being examined. The tolerance could then be made dependent on that distance. The tolerance could be zero for large distances and increase as the distance decreases. This distance value could also be employed to vary the stringency of the DPL-site criterion imposed in step 120.

Of course, this is only a very rough approach to estimating the optimal tolerance level, since it takes into account only the distance to the first DPL site, not the number of DPL sites in that distance. A further refinement would employ this general approach but modify it slightly. In the present test represented by the loop of steps 120, 122, and 124, the routine exits the loop when a DPL site has been found. In accordance with the further refinement, the routine would note where the first DP site is located but keep searching for further DPL sites, keeping track of the total number of them until it reaches the location identified by the main pointer. The tolerance would then depend on the number of intervening DPL sites, not just on the distance between the first available one and the location of the current pixel.

A still further refinement, applicable to either of the foregoing approaches, is to consider not all unused DPL sites but only DPL sites to which palette-memory locations are available whose contents can safely be changed. That is, instead of only steps 120-124, the sequence inserted between steps 106 and 108 would be steps 120–124, 130, 132, and 140–144.

Automatic side-border adjustment could be provided by increasing the border size and starting over whenever the result of the test of step 124 is negative, i.e., whenever the routine runs out of DPL sites.

Although we believe that these refinements will result in improved performance, we have used only the simpler, illustrated approach so far.

The discussion of the dynamic-palette-loading routine has so far dealt only with encoding source words that have not been adopted for encoding as mixes. If the outcome of step 106 is positive, however, indicating that the current pixel is to be encoded as a mix, the routine proceeds to step 146, in which it calculates the mix value to be entered for the current pixel. This calculation is based on the palette values that have now been assigned to the end words for the run of which the subject pixel is a part. It will be recalled that the mix-run-encoding routine has placed the two "end" values in a run ahead of the run's mix values, so step 146 fetches the palette values assigned to the last two non-mix words.

Many approaches to calculating an acceptable mix are possible. The one that we use calculates the differences between the respective red, green, and blue components of the end values, determines which difference is the largest, and calculates the mix in accordance with the component that resulted in the largest difference. For instance, suppose that the difference $|x_{LR}-x_{RR}|$ between the red components of the end values is larger than the corresponding green and blue differences. Then the mix for a pixel whose source value is $X_s$ will be given by $$32(x_{SR}-x_{LR})/(x_{RR}-x_{LR}).$$

In step 148, the code for this mix is entered into the display-memory location for the current pixel, and the routine proceeds to the next pixel. When the main loop of FIG. 4 has operated on every pixel, the encoding process is complete.

It is apparent that the teachings of the present invention are applicable to systems that employ mix-run codes that differ significantly from the illustrated code. The illustrated code uses two characteristic pixel values for each run, employs two of the sequence's source pixel values as the characteristic value, and chooses as those two source pixel values the ones represented by the left and right endpoint words of the sequence. It is efficient from a coding standpoint to adopt as a run's characteristic values those of pixels at positions that are the same in every run. If this approach is adopted, the longest runs result if the predetermined positions are the endpoints of the run, since shades in small areas of an image tend to progress with position. The codes described in the '605 patent therefore use the values of sequence endpoints as their characteristic values, as does the illustrated embodiment of this invention. However, none of these features is a necessary requirement of a mix-run code. As was previously stated, for instance, the code described above can be employed with an encoding process that does not limit characteristic values to endpoints. All that is necessary in principle is that the encoded image include runs of pixel words in which at least one word specifies its pixel value at least partly as a fraction of a pixel value that must be obtained from another pixel word.

Indeed, one can envision mix-run codes in which the characteristic values differ from all of the pixel values represented by the source pixel words in a sequence. The code could even mix three or more characteristic pixel values, or it could employ a "mix," i.e., a fraction, of a single pixel value that another word represents. All of these would require error criteria for encoding, and all would benefit from, for instance, the technique of reducing the error criterion as sequence length increases.

Accordingly, the present invention represents a significant advance in the art.

What is claimed is:

1. For displaying images represented by a source signal that represents pixel values in a pixel-by-pixel manner, an apparatus comprising:

A) a display mechanism having a screen comprising screen locations corresponding to respective image pixels, the display mechanism being adapted for reception of a display input comprising run-code pixel words, each of which corresponds to a respective pixel in an image, that represent pixel value in accordance with a run code such that the set of the run-code pixel words corresponding to all pixels in the image includes a plurality of runs of run-code pixel words, each run including at least one run-code pixel word that represents the pixel value of its corresponding pixel as a mix of values of a characteristic set of pixel values without additionally containing all of the values the characteristic set, for scanning the screen locations in a screen sequence and displaying, at the scanned screen locations corresponding to the image pixels to which the run-code pixel words in the run correspond, the sequences of pixel values that the runs represent in accordance with the run code;

B) a display-memory circuit, including display-memory locations that correspond to the respective screen locations and to the pixels to which the screen locations correspond and being operable to store in its display-memory locations corresponding run-code pixel words containing pixel values encoded in accordance with the run code, for scanning the display-memory locations in a sequence that tracks the scanning of the corresponding screen locations, for generating a display-memory output representative of the contents of the scanned memory locations, and for applying the display-memory output to the display mechanism as its display input; and C) an encoder, adapted to receive a source signal comprising source pixel words associated with respective image pixels, each pixel word representing the pixel value of its respective image pixel without reference to the pixel values of other pixels, for encoding sequences of the source pixel words into runs of the run-code pixel words in accordance with the run code and operating the display-memory circuit to store the run-code pixel words in the display-memory locations that correspond to the image pixels to which the respective run-code pixel words correspond.

2. An apparatus as defined in claim 1 wherein the encoder encodes the source pixel words into run-code pixel words by encoding into runs of run-code pixel words only sequences of source pixel words that represent values that can be approximated by mixes of the same characteristic values within a predetermined maximum error that varies with the length of the sequence.

3. An apparatus as defined in claim 2 wherein the maximum error decreases with sequence length.

4. An apparatus as defined in claim 3 wherein the predetermined maximum error is a percentage error for shorter sequences and an absolute error for longer sequences.

5. An apparatus as defined in claim 1 wherein the encoder encodes the source pixel words into run-code pixel words by:

A) selecting a sequence of at least three of the source pixel words as a candidate sequence, the candidate sequence thereby comprising a beginning word and an ending word and at least one intervening word;

B) if the pixel values represented by all intervening words can be approximated within a predetermined maximum error by mixes of the pixel values represented by the beginning and end words of the candidate sequence, accepting the candidate sequence as an acceptable sequence, adding a new source pixel word to the end of the candidate sequence, and repeating this step with the next candidate sequence; and C) if not all the pixel values represented by the intervening pixel words can be approximated within a predetermined maximum error by mixes of the pixel values represented by the beginning and end words of the candidate sequence, adding a new source pixel word to the end of the candidate sequence and repeating the previous step if the candidate sequence meets a predetermined criterion that indicates the existence of a possible pixel value such that the pixel values represented by the end and intervening words of the candidate sequence can all be approximated by mixes of the possible pixel value and the pixel value represented by the beginning word of the candidate sequence, and, if there is no such possible pixel value, adopting the last acceptable candidate sequence and generating a run-code run therefrom.

6. An apparatus as defined in claim 5 wherein the predetermined criterion that the encoder employs as an indication of the existence of a possible pixel value from which the intervening candidate-sequence pixel words can be approximated is that the sequence contains a local-maximum pixel word such that the other pixel words of the candidate sequence can be approximated by mixes of the pixel values represented by the local-maximum pixel word and the beginning word of the candidate sequence.

7. An apparatus as defined in claim 5 wherein the predetermined criterion that the encoder employs as an indication of the existence of a possible pixel value from which the intervening candidate-sequence pixel words can be approximated is that all of the pixel values represented by pixel words in the candidate sequence fall within a predetermined maximum distance from the line that represents the best least-squares fit to those pixel values.

8. An apparatus as defined in claim 1 wherein the characteristic set of pixel values employed for each run by the run code in accordance with which the encoder encodes and the display mechanism displays consists of two pixel values.

9. An apparatus as defined in claim 8 in which the two characteristic values that the encoder employs in encoding a sequence of source pixel words into a run of run-code pixel words are the values that approximate those represented by the first and last pixel words in the sequence of source pixel words.

10. An apparatus as defined in claim 9 wherein the encoder encodes a sequence of source pixel words into a run of run-code pixel words in which the first run-code pixel word represents the first characteristic value, the second run-code pixel word in the run represents the second characteristic value, and the remaining run-code pixel words of the run represent mixes of the characteristic values that approximate the pixel values represented by the third through last source pixel words of the source sequence.

11. An apparatus as defined in claim 8 wherein the encoder encodes a sequence of source pixel words into a run of run-code pixel words in which the first run-code pixel word represents the first characteristic value, the second run-code pixel word in the run represents the second characteristic value, and the remaining run-code pixel words of the run represent mixes of the characteristic values that approximate the pixel values represented by the third through last source pixel words of the source sequence.

12. An apparatus as defined in claim 11 wherein the encoder encodes each sequence of source pixel words into a run of run-code pixel words in which the first run-code pixel word in the run represents the pixel value that approximates the pixel value represented by the first source pixel word in the sequence.

13. An apparatus as defined in claim 8 wherein the display mechanism displays for each run a sequence of displayed pixel values in which the first and second displayed pixel values are the value represented by the first pixel word in the run and each of the remaining display pixel values is the value that results from mixing the pixel values represented by the first two pixel values in the run in accordance with the mix value that the corresponding run-code pixel word represents.

* * * * *